United States Patent [19]

Leib

[11] Patent Number: 4,784,435

[45] Date of Patent: Nov. 15, 1988

[54] PATIENT CHAIR

[76] Inventor: Roger K. Leib, 1064 Crescent Heights, Los Angeles, Calif. 90035

[21] Appl. No.: 937,485

[22] Filed: Dec. 3, 1986

Related U.S. Application Data

[63] Continuation of Ser. No. 833,977, Feb. 26, 1986.

[51] Int. Cl.[4] ..... A47C 1/02

[52] U.S. Cl. ..... 297/445; D6/362; 297/458; 297/460

[58] Field of Search ..... 297/447, 460, 456, 302, 297/411, 458, 445; D6/362, 372

[56] References Cited

U.S. PATENT DOCUMENTS

| | | | |
|---|---|---|---|
| Re. 20,372 | 5/1937 | Lorenz . | |
| Re. 27,176 | 9/1971 | Froelich | 297/284 |
| D. 90,705 | 9/1933 | Goodman | 297/296 |
| D. 232,215 | 7/1974 | Lamb | D6/372 |
| D. 254,042 | 1/1980 | Hosoe | D6/372 |
| D. 262,502 | 1/1982 | Wilson | D6/1 |
| D. 272,967 | 3/1984 | Umanoff | D6/372 |
| D. 282,901 | 9/1986 | Petersen | D6/1 |
| 458,140 | 8/1881 | Bangs | 297/460 |
| 693,323 | 2/1882 | Rodgers . | |
| 1,791,453 | 2/1931 | Mies . | |
| 1,928,939 | 10/1933 | Larsen | 297/295 |
| 1,950,226 | 3/1934 | Cable . | |
| 1,979,073 | 10/1934 | Larsen . | |
| 2,064,137 | 12/1936 | Zerbee | 297/287 |
| 2,069,456 | 2/1937 | McGowen | 297/283 |
| 2,071,084 | 2/1937 | Nolan . | |
| 2,121,130 | 6/1938 | McGowen . | |
| 2,135,657 | 11/1938 | Church . | |
| 2,186,705 | 1/1940 | Lorenz . | |
| 2,530,924 | 11/1950 | Turner . | |
| 2,586,262 | 2/1952 | Robins | 297/294 |
| 2,625,205 | 1/1953 | Holmes . | |
| 2,679,893 | 6/1954 | Bennet | 297/282 |
| 2,699,200 | 1/1955 | Lingle . | |
| 2,905,230 | 9/1959 | Gabriel | 297/460 X |
| 2,970,638 | 2/1961 | Halter . | |
| 3,092,417 | 6/1963 | Drabert | 297/391 |
| 3,101,217 | 8/1963 | Requa | 297/391 |
| 3,131,970 | 5/1964 | McGregor | 297/445 |
| 3,147,997 | 9/1964 | Mason | 297/452 |
| 3,165,356 | 1/1965 | Geier et al. | 297/216 |
| 3,259,427 | 7/1966 | Wiest | 297/DIG. 10 |
| 3,343,871 | 9/1967 | Yates | 297/DIG. 10 |
| 3,361,471 | 1/1968 | Radford | 297/230 |
| 3,379,450 | 4/1968 | Jones et al. | 297/DIG. 10 |
| 3,379,474 | 4/1968 | Schwarz, Jr. | 297/440 |
| 3,606,464 | 9/1971 | Arbuthnot | 297/460 |
| 3,677,601 | 7/1972 | Morrison et al. | 297/456 |
| 3,716,270 | 2/1973 | Frazier | 297/377 |
| 3,762,769 | 10/1973 | Poschl | 297/284 |
| 3,815,955 | 6/1974 | Gililterra | 397/245 |
| 3,876,250 | 4/1975 | Eberle | 297/446 |
| 4,049,315 | 9/1977 | Jacobson | D6/372 |
| 4,067,606 | 1/1978 | Desmoulins et al. | 297/141 |
| 4,234,228 | 11/1980 | Flamm | 297/464 |
| 4,529,246 | 7/1985 | Leib | 297/285 |
| 4,555,139 | 11/1985 | Leib | 297/445 X |
| 4,677,664 | 3/1978 | Harder, Jr. | 297/183 |

FOREIGN PATENT DOCUMENTS

| | | | |
|---|---|---|---|
| 560673 | 9/1932 | Fed. Rep. of Germany . | |
| 869114 | 3/1953 | Fed. Rep. of Germany . | |
| 633980 | 10/1927 | France | 297/302 |
| 764919 | 3/1934 | France . | |
| 907057 | 6/1945 | France . | |
| 1072212 | 3/1954 | France | 297/302 |
| 529845 | 6/1955 | Italy . | |
| 74283 | 3/1930 | Sweden . | |
| 416758 | 9/1934 | United Kingdom . | |

OTHER PUBLICATIONS

Thonet IDG Kangaroo Chair *Interior*, Nov. 1976, p. 28.
Add Interior Systems, Inc., "Rose Chair," 10/82.
MIES Chair Designs, a sales brochure published by Kroll International, New York more than one year prior to the filing of the subject application.
Warren Chair Photo. Published by Add Interior Systems in a about 02/02/81.
Chair Photo by Add Interior Systems.
U.S. patent application Ser. No. 937,485.

*Primary Examiner*—James T. McCall
*Attorney, Agent, or Firm*—Sheldon & Mak

[57] ABSTRACT

A patient-type chair is provided which is capable of a gentle rocking motion and which comprises rigid armrests for ease of ingress and egress. The chair comprises a base having a pair of substantially rigid front legs. The legs extend vertically and then rearwardly in a substantially horizontal disposition to form rigid armrests. The chair further comprises a back attached to a seat, the seat being rearwardly cantilevered from points on the front legs which are below the armrests.

36 Claims, 10 Drawing Sheets

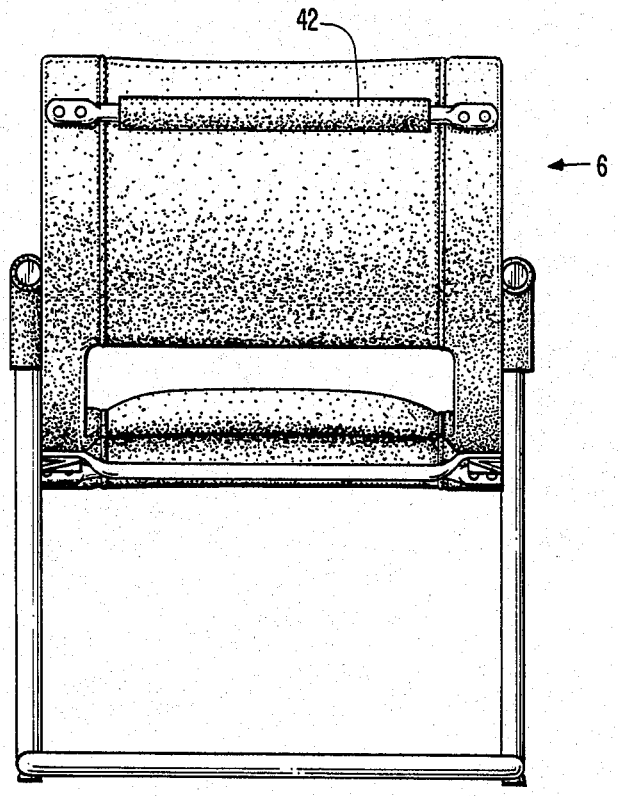
FIG. 4
FIG. 6
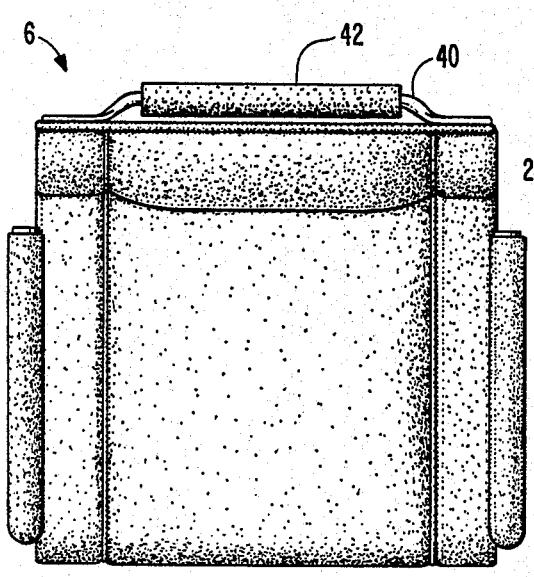
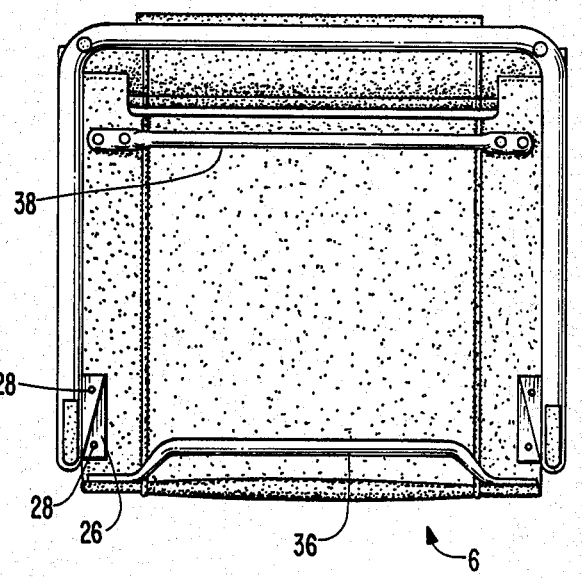
FIG. 5

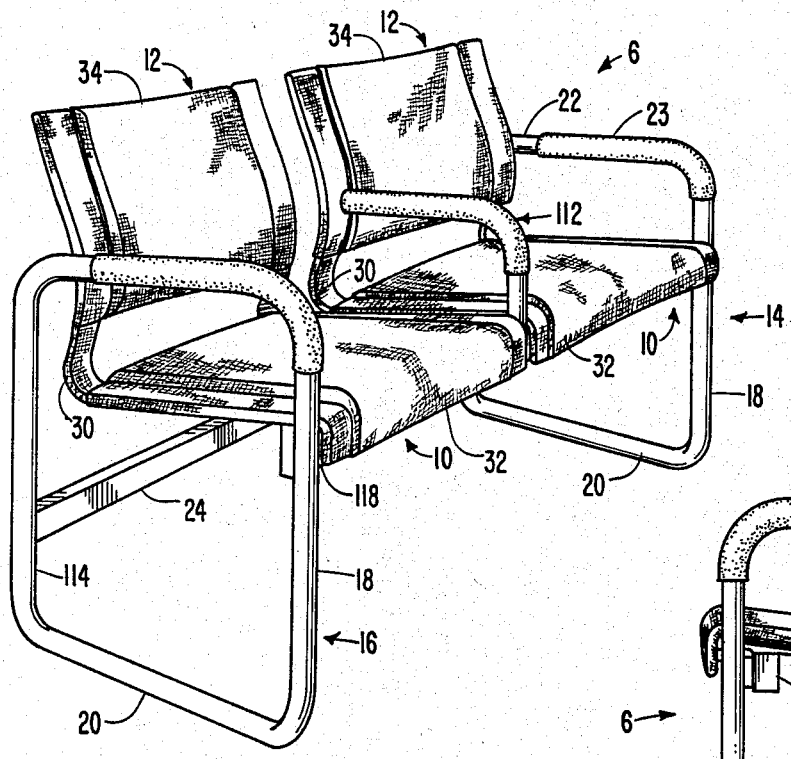
FIG. 13
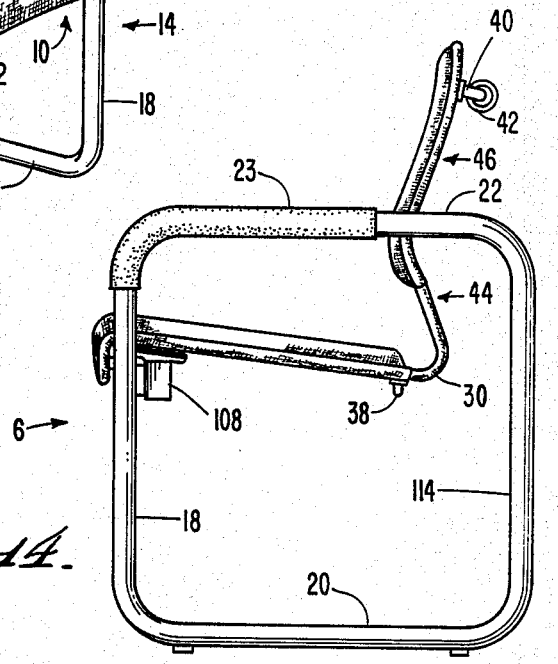
FIG. 14
FIG. 15
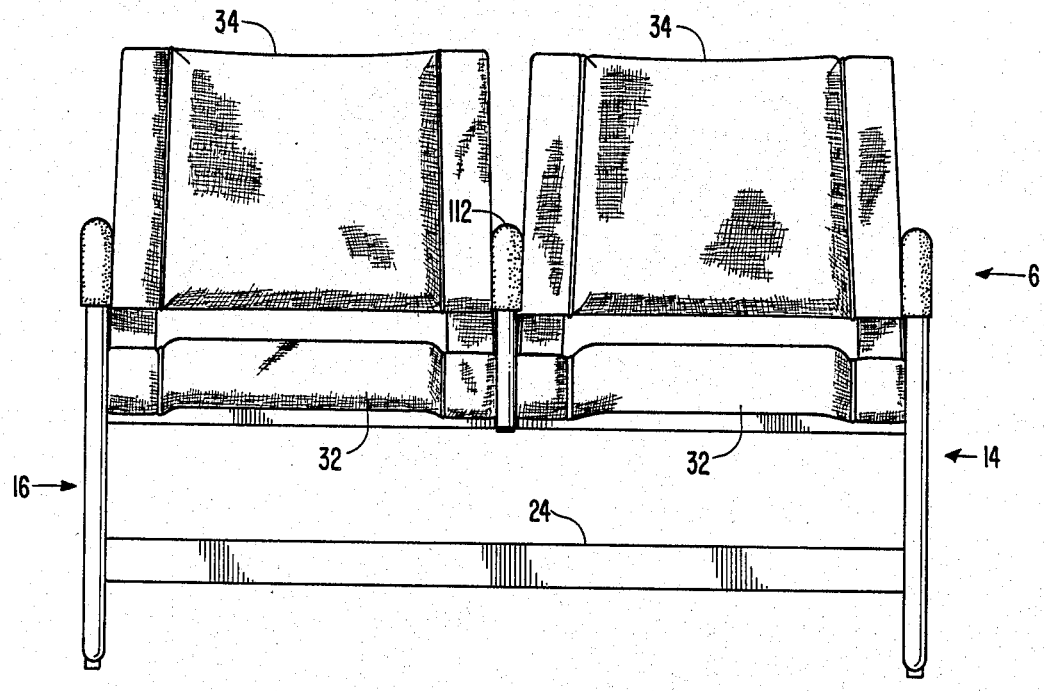

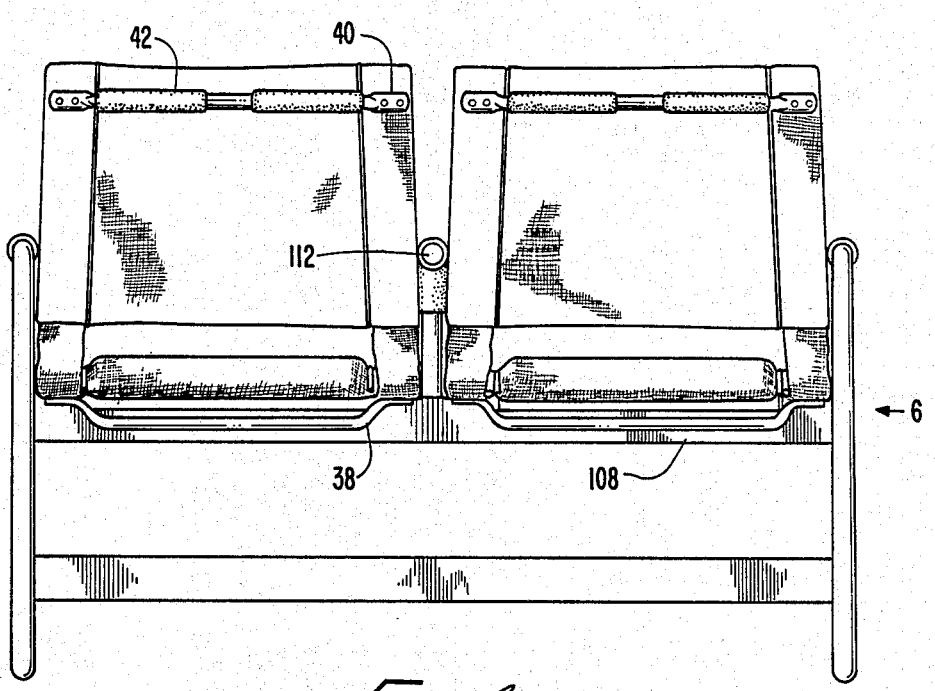
FIG. 16.
FIG. 11.
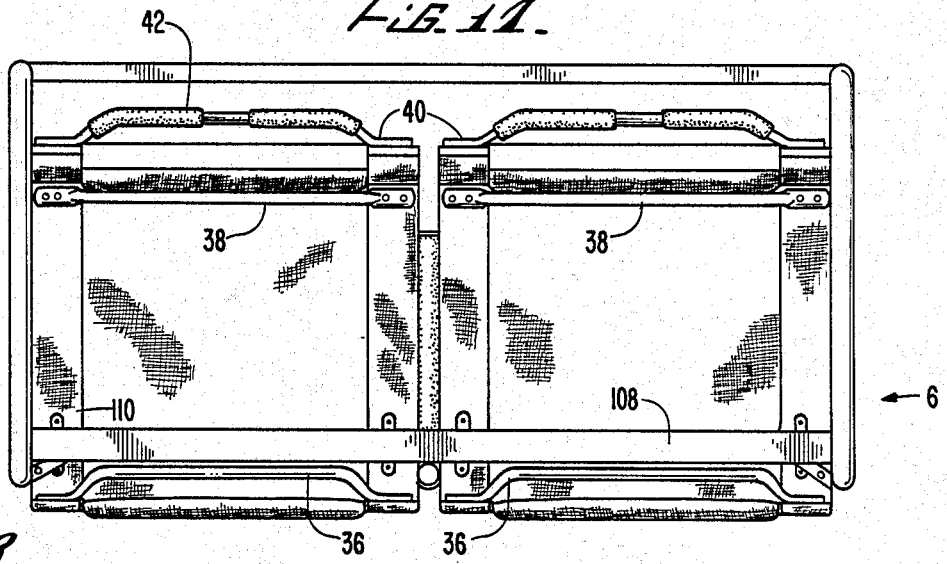
FIG. 18.
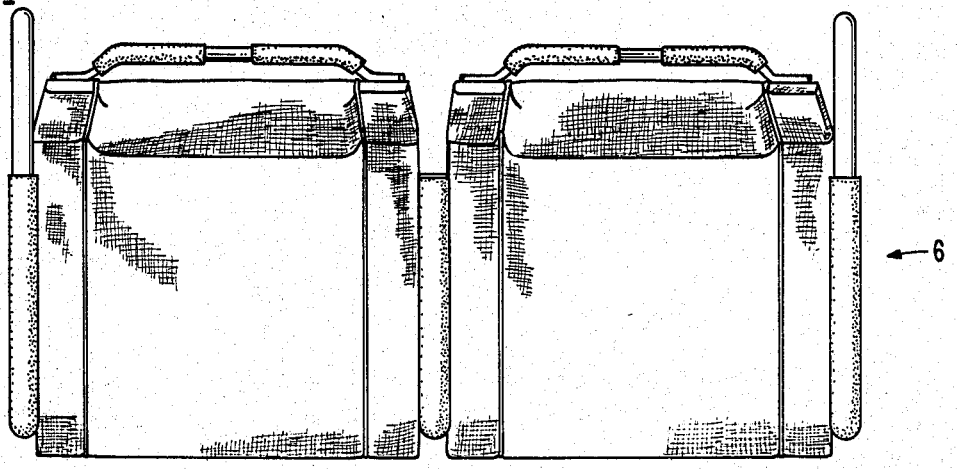

PATIENT CHAIR

This is a continuation of application Ser. No. 833,977, filed Feb. 26, 1986.

BACKGROUND

The present invention is directed to a chair and specifically to a chair having characteristics which yield particular benefit to weakened, partially disabled, or inform individuals.

Individuals suffering from various musculoskeletal conditions or neuromuscular disorders have unique needs with respect to a chair. A chair for such an individual must be comfortable for long periods of time, it must provide easy ingress and egress, and it must provide a stable base of support.

Ease of egress in a patient-type chair is very important. Egress involves postural changes and dynamic balance adjustments, changes and adjustments which pose particular difficulty for weak or infirm individuals, especially those with Parkinson's Disease, lower limb arthritis or chronic back pain. The difficulty encountered by such individuals in egressing from standard chairs frequently results in virtual "chair confinement," thereby threatening the continued independence of the individual. Futhermore, even if such an individual can manage to egress from the chair, the difficulty required in the effort can have a dramatically adverse effect on the individual's functional independence. For instance, older individuals suffering from Parkinson's Disease are generally quite weak. The complex biomechanical movements necessary to complete an egress require a certain amount of strength. This amount is significant to someone with low muscular reserves. The result is often that, upon egress, there is little remaining strength for continuing walking movements and the individual either proceeds with dangerously shaky, wobbly movements or is forced to sit down again. On the other hand, individuals with lower limb arthritis generally initiate the egressing movements with considerably more strength than the individual suffering from Parkinson's Disease, but the pain encountered in the effort to egress often saps this strength and upon egress leaves the individual in a precariously unstable condition. Such patients frequently avoid ambulating and spend long periods of time in inactivity, thereby exacerbating their orthopedic problems due to loss of muscle tone and increased stiffness of joints.

Conventional chairs are generally either difficult to egress or are uncomfortable to sit in for long periods of time. A patient-chair design should not sacrifice comfort in an effort to provide increased ease of egress, since weak and infirm individuals must of necessity spend long periods of time sitting down. Unfortunately, the more padded a chair is, the more difficult it generally is to egress from it.

Patient-chairs should also provide a stable base of support to compensate for a patient's lack of agility in counterbalancing movements. Providing a stable base of support is important in a patient-chair since the egressing effort frequently leaves an invalid shaky and wobbly. A chair which is unstable an an object of support can be dangerous to the weakened or invalid individual because the natural tendency when losing one's balance in the use of a chair is to attempt to support oneself by grabbing that chair.

Fixed-base chairs of the prior art which provide a gentle rocking motion but whose armrests "rock" with the seat, almost always require large bases. This is because the seat is almost always set back from the front legs to provide a stable surface (i.e., the armrests immediately above the front legs) against which the user can push during ingress and egress. This is not necessary with the chair of the invention because its armrests are rigid along their entire length, not merely at a single point over the front legs.

There is therefore a need for a patient-type chair that is easy to egress, that provides a stable article for support, and that is comfortable for long periods of time.

SUMMARY

The chair of the present invention satisfies this need. The present invention is directed to a chair which is primarily, although not exclusively, intended for use by the weakened or infirm user such as are typically found in hospitals, nursing homes, extended care facilities, and sick rooms. The present invention is further primarily directed at the geriatric, orthopedic, post-surgical, psychiatric and maternity patients. It is particularly suited to those applications because it is easy to enter and exit, provides, without moving parts, a soothing slight rocking motion that increases rearwardly in order to shift and redistribute body weight without lifting the chair's feet off the floor, while maintaining fully stable armrests against which to push during egressing and ingressing, and provides a stable object of support.

The chair comprises a seat means, two arm rests and structure means. The seat means is a rearwardly extending and downwardly deflecting means for supporting a human body in a seated position. The armrests are a pair of substantially parallel rearwardly extending, non-deflecting structures disposed in spaced relation to one another. The structure means affixes the seat means below the armrests in such a way that the seat means is non-downwardly deflecting at its forward-most edge, and so that an individual seated upon the chair can support each of his arms upon one of the armrests and so that an individual ingressing into and egressing from the chair can support his weight by pressing against the armrests with his hands.

In one embodiment, the chair comprises a base, a seat, a means for attaching the seat to the base, and a back. The base comprises a pair of substantially rigid front legs affixed in spaced relation to one another. Each front leg extends upwardly in a substantially vertical direction and then rearwardly in a substantially horizontal direction to form a rigid armrest. The seat has a front and a rear. It is affixed near its front to the front legs such that the seat is cantilevered from the front legs. The armrests are affixed to the base such that they are substantially rigid. The armrests are disposed horizontally above and along opposite sides of the seat.

Preferably the seat deflects downwardly a distance of between about 0.2 and 0.5 inches when a 100 pound weight is placed on the seat at a distance about 12 inches rearwardly from the front of the seat. The back is attached to the seat and extends substantially vertically above the seat. Preferably the back support structure is a continuous extension of the seat support structure and is capable of deflection in a rearward direction a distance of between 1 and 2 inches when subjected to a horizontal, rearwardly-acting force of 50 pounds applied about 12 inches above the seat.

As used herein, the term "cantilevered" refers to the hair seat and means "rigidly attached along one side of the seat such that the opposite side is unattached and the seat is suspended in a generally horizontal direction." Also, the term "rigid" means "essentially incapable of deflection under conditions of normal use."

Optionally, the chair has at least one U-shaped transverse bar seat brace and a removable chair seat comprising (i) a cover defining an interior seat volume which has a topside, a bottom side, a left side, a right side, a forward end and a rear end, wherein the cover has a rear edge opening across the length of the rear end and a transverse bar opening which, when the seat is attached to the chair, is aligned with the U-shaped transverse bar, (ii) a seat pad disposed within the cover, the seat pad being of substantially the same size and shape as the interior seat volume, (iii) a rear end fastener for closing the rear edge opening, and (iv) a transverse bar opening fastener for closing the transverse bar opening except for a left gap at the left side of the transverse bar opening and a right gap at the right side of the transverse bar opening, wherein the left gap and the right gap have substantially the same diameter as the U-shaped transverse bar so that, when the chair seat is in use with the transverse bar opening fastener closed, the U-shaped transverse bar protrudes out of the left gap and back into the right gap.

The chair may also have at least one U-shaped transverse bar back brace and a removable chair back comprising (i) a cover defining an interior back volume which has a forward side, a rearward side, a left side, a right side, an upper end and a lower end, wherein the cover has a lower edge opening across the length of the lower end and a transverse bar opening which, when the back is attached to the chair, is aligned with the U-shaped transverse bar, (ii) a back pad disposed within the cover, the back pad being of substantially the same size and shape as the interior back volume, (iii) a lower end fastener for closing the lower edge opening, and (iv) a transverse bar opening fastener for closing the transverse bar opening except for a left gap at the left side of the transverse bar opening and a right gap at the right side of the transverse bar opening, wherein the left gap and the right gap have substantially the same diameter as the U-shaped transverse bar so that, when the chair back is in use with the transverse bar opening fastener closed, the U-shaped transverse bar protrudes out of the left gap and back into the right gap.

The present invention provides a chair which is comfortable for long periods of continuous sitting, provides a slight lilting motion, allows for safe and easy ingress and egress, leans the sitter into the chair, and provides a stable base of support.

DRAWINGS

These and other features, aspects and advantages of the present invention will become better understood with reference to the following description, appended claims and accompanying drawings where:

FIG. 4 is a rear view of the chair of FIG. 1;

FIG. 5 is a top view of the chair of FIG. 1;

FIG. 6 is a bottom view of the chair of FIG. 1;

FIG. 7 is a perspective view of a second chair embodying features of the invention;

FIG. 13 is a prospective view of a third chair embodying features of the invention.

FIG. 14 is a left side view of the chair of FIG. 13;

FIG. 15 is a front view of the chair of FIG. 13;

FIG. 16 is a back view of the chair of FIG. 13;

FIG. 17 is a bottom view of the chair of FIG. 13;

FIG. 18 is a top view of the chair of FIG. 13.

DESCRIPTION

Figure 1:
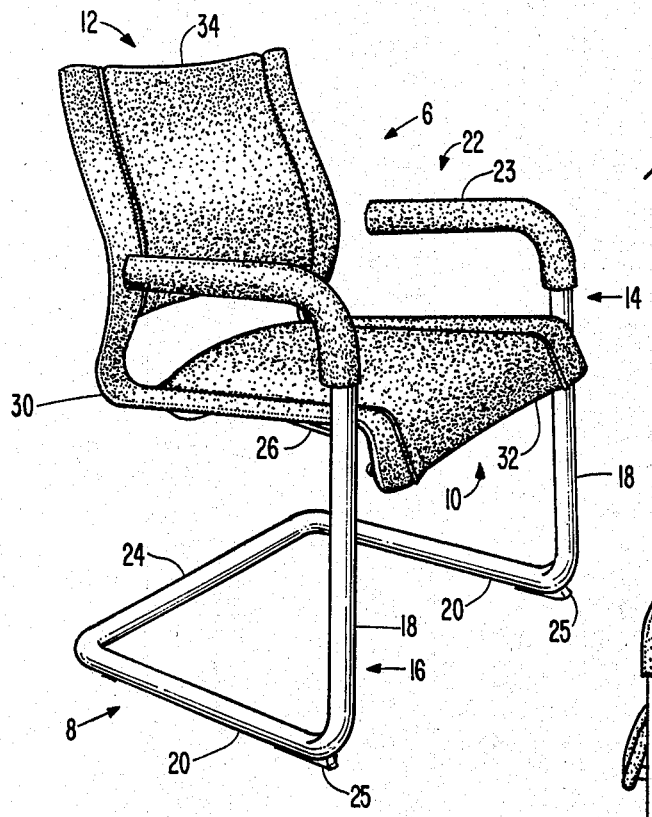
FIG. 1 is a perspective view of a first chair embodying features of the invention.
Figure 2:
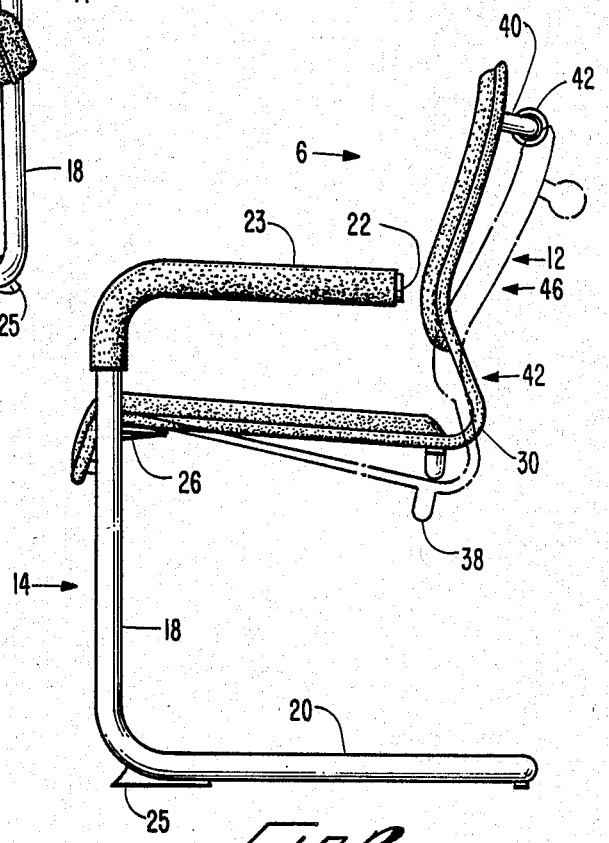
FIG. 2 is a left side view of the chair of FIG. 1.
Figure 3:
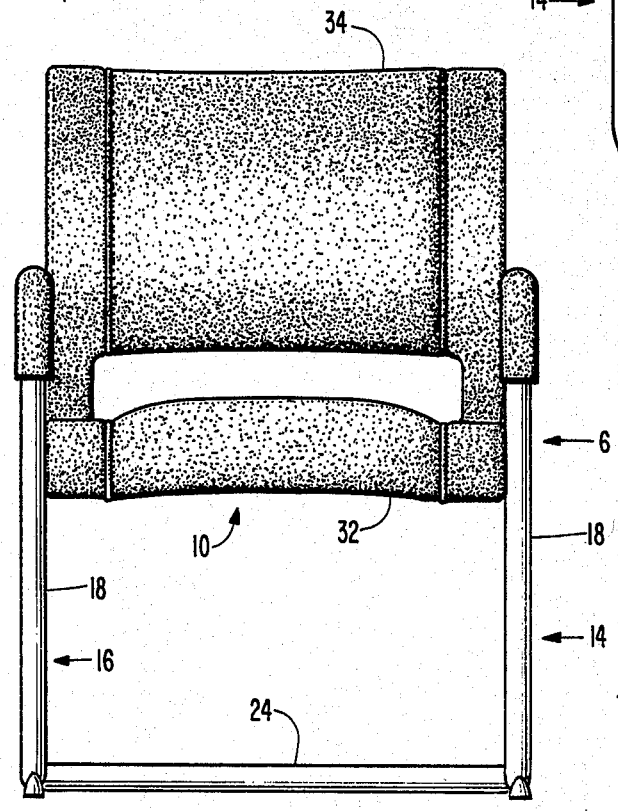
FIG. 3 is a front view of the chair of FIG. 1.
Figure 1:
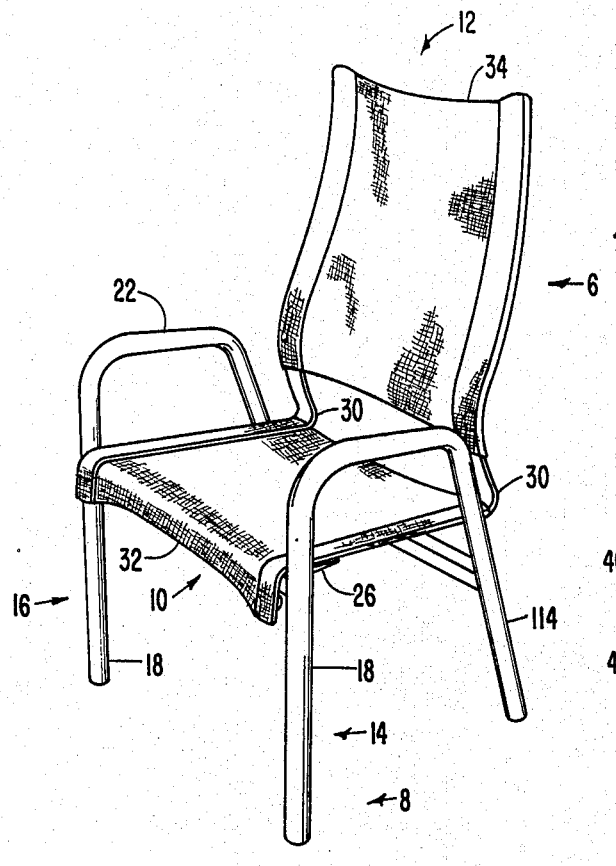
Figure 8:
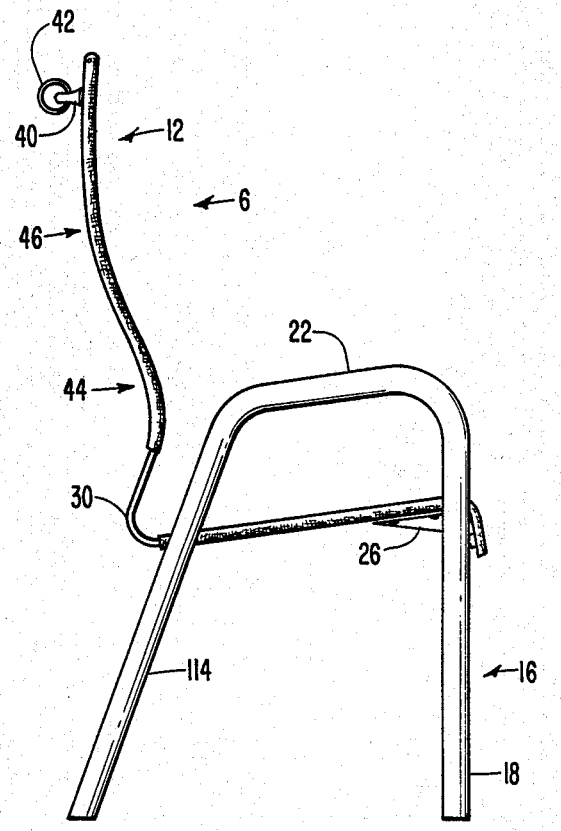
FIG. 8 is a right side view of the chair of FIG. 7.
Figure 9:
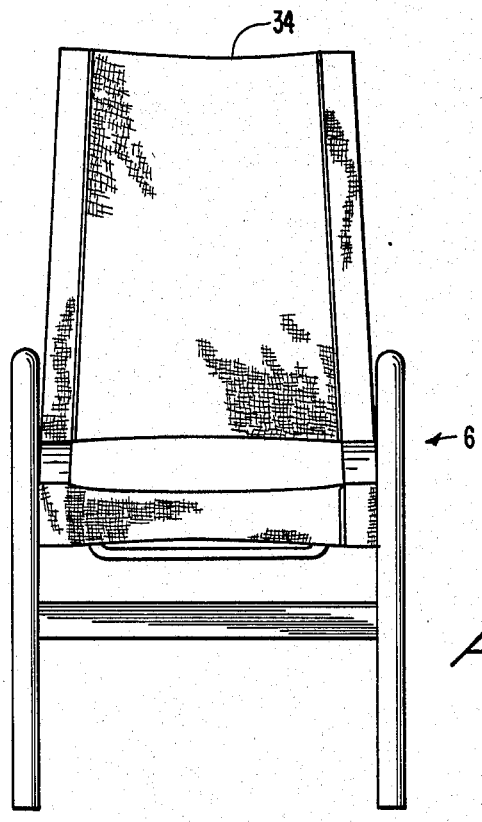
FIG. 9 is a front view of the chair of FIG. 7.
Figure 10:
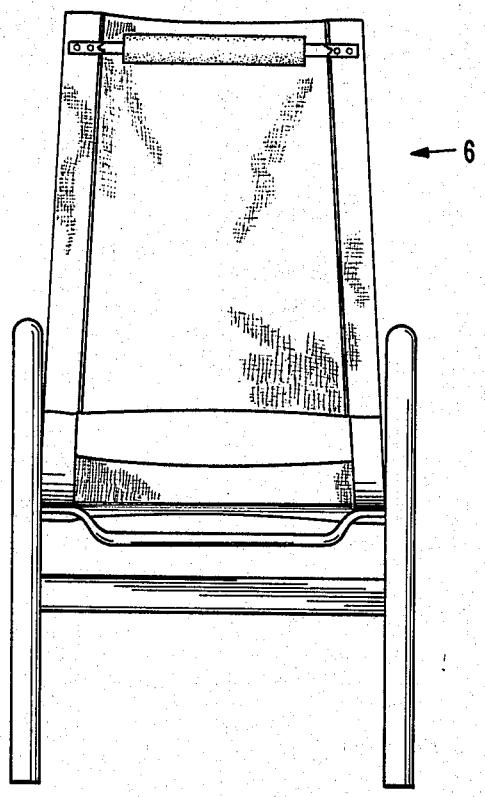
FIG. 10 is a rear view of the chair of FIG. 7.
Figure 11:
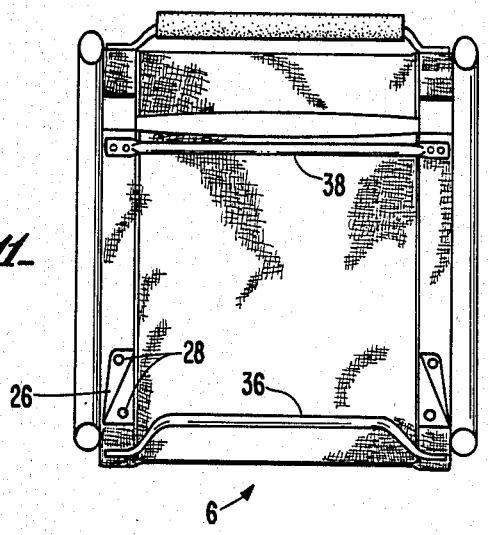
FIG. 11 is a bottom view of the chair of FIG. 7.
Figure 12:
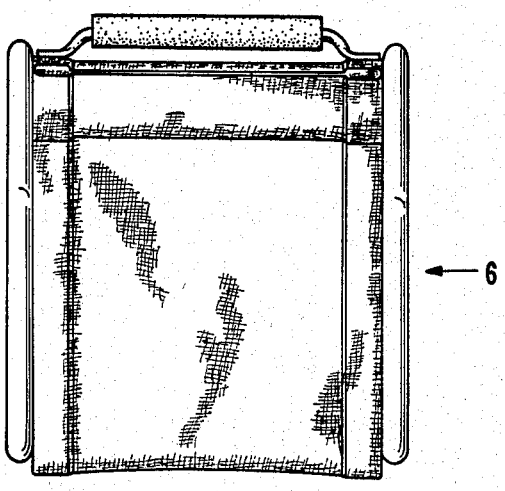
FIG. 12 is a top view of the chair of FIG. 7.

With reference to the figures, a chair 6 embodying features of the invention comprises a base 8, a seat 10 and a back 12.

The base 8 comprises a left base piece 14 and a right base piece 16. The base pieces 14 and 16 are each comprised of an essentially non-deflecting front leg 18, a rearwardly extending sled base member 20, and an armrest 22. The front legs 18 are disposed generally vertically, being disposed with respect to the horizontal at an angle between about 45° and 135°, preferably, for axial strength and to minimize base dimensions, at an angle between about 80° and 100°. Each armrest 22 is formed as an upper extension of one of the front legs 18, which upper extension is bent rearwardly from a generally vertical disposition to a substantially horizontal disposition. For comfort and aesthetics, each armrest 22 is preferably covered with an armrest cover 23 constructed of a suitable material such as an abrasion- resistant molded tubular plastic. Each sled base member 20 is connected at one of its ends to the lower end of one of the front legs 18 and is horizontally and rearwardly disposed. Preferably, to maximize stability, each front leg 18 is affixed to one of the sled base members 20 and one of the armrests 22 in such a way that both of the sled base members 20 and the armrests 22 are disposed in substantially the same vertical plane.

The left base piece 14 and the right base piece 16 are affixed in rigid spaced relation to one another so as to form a support structure for the seat 10 and the back 12. Preferably, for maximum strength and stability, the left base piece 14 and the right base piece 16 are affixed in substantially parallel vertical planes.

The left base piece 14 and the right base piece 16 are affixed in spaced relation at the front legs 18 by attachment to opposite sides of the seat 10 and at the rear ends of the sled base members 20 by attachment to a lateral brace 24. The lateral brace 24 is affixed at its one end to the rear end of the left sled base member and at its other end to the rear end of the right sled base member.

The left base piece 14 and the right base piece 16 are constructed of a suitable structural material such as tubular steel. The lateral brace 24 is likewise constructed of a suitable structural material such as tubular steel.

Figure 24:
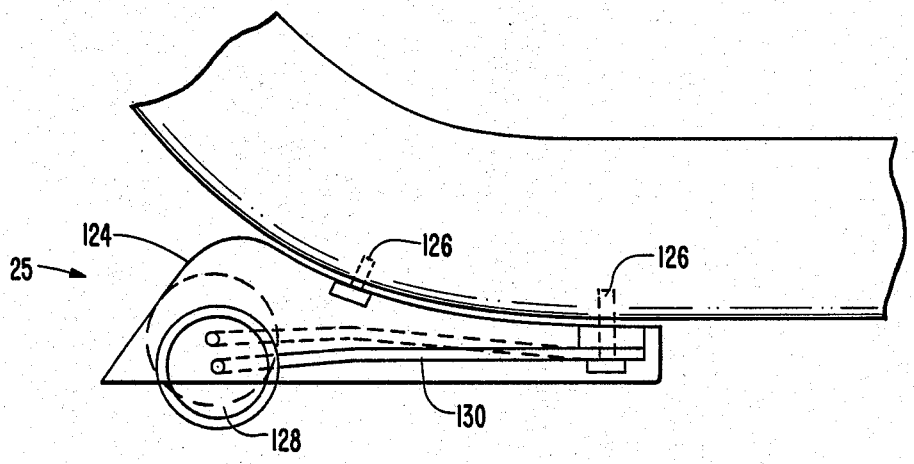
FIG. 24 is a side view of a glide embodying features of the invention.

In the configuration shown in the drawings wherein the front legs 18 and the rearwardly extending sled base members 20 are joined at rounded corners, glides 25 are preferably affixed to the underside of the forward-most ends of the sled base members 20 to restrict the chair's tendency to tip in the forward direction. FIG. 24 illustrates a preferred embodiment of a glide 25. The glide 25 comprises a hollow wedge 124 which is affixed to the forward-most underside of the rearwardly extending sled base member 20 by means of rivets 126. The hollow wedge 124 is open on its underside. Housed within the hollow wedge 124 is wheel 128 which is rotatably mounted in a vertical plane to a leaf spring 130. The leaf spring 130 is affixed to the hollow wedge 124 with the rear-most rivet 126. The wheel 128 and the leaf spring 130 are sized and adapted so that (i) when the chair 6 is unoccupied, the chair 6 is supported by the wheel 128 and the leaf spring 130 and the wheel 128 is free to rotate, and (ii) when the chair 6 is occupied, the wheel 128 is retracted within and up against the hollow wedge 124 so that the chair 6 is supported by the wheel 128 and the hollow wedge 124. When the wheel 128 and the leaf spring 130 are so sized and adapted, the chair 6 can be slid across the floor when unoccupied with minimum chair-to-floor friction and is substantially immobilized when occupied. The hollow wedge 124 can be made of clear polycarbonate and the wheel 128 can be made of polyurethane or other suitable material. The leaf spring 130 can be made of heat-treated and tempered spring steel.

The seat 10 is attached to each front leg 18 with a bracket 26. Each bracket 26 is rigidly attached to the inside of one of the front legs 18. The seat 10 is affixed to the bracket 26, as by being clamped to the bracket 26 with bolts 28. Preferably, rubber spacers 29 are disposed between the seat 10 and the bracket 26 so as to minimize the concentration of "point loads" on the side frames 30 and to enhance the lilting movement of the chair.

The seat 10 comprises two continuous substantially parallel side frame members 30 and a seat center piece 32. The side frame members 30 can be formed of flat alloy or spring steel barstock, heat treated and tempered to have spring action mechanical properties. The seat center piece 32 can be a fabric piece formed of a fabric material such as polyester mesh stretched horizontally between the side frame member 30. Optionally, the seat center piece 32 can also be padded or upholstered.

The side frame members 30 are disposed in a substantially L-shaped configuration with the horizontal portions forming the frame for the seat 10 and with the vertical portions forming the frame of the back 12. The back 12 further comprises a back center piece 34 which, like the seat center piece 32, can be a fabric piece formed of a fabric material such as polyester mesh stretched vertically between the side frame members 30. Also, the back center piece 34 can be padded or upholstered.

The seat center piece 32 and the back center piece 34 can be maintained in spaced relationship by being affixed to the side frame members 30, to decorative strips covering exposed areas of the side frame members 30 (not shown), or to each other as by use of a cord (not shown) strung between the rear corners of the seat center piece 32 and the lower corners of the back center piece 34 along the backs of the side frame members 30.

The side frame members 30 are affixed in spaced relation to one another by three cross-connecting transverse bars, each affixed at a first end to one of the side frame members 30 and at a second end to the other of the side frame members 30. A forward seat transverse bar 36 is disposed on the underside of the seat 10, near the front edge. A rearward seat transverse bar 38 is likewise disposed on the underside of the seat 10 but near the rear edge. An upper back transverse bar 40 is disposed on the rearward side of the back 12 near the top. To protect a wall on the rearward side of the back 12 from contact caused by the rearward deflection to the back 12, a tubular pad 42 can be affixed about the exterior of the upper back transverse bar 40. The three transverse bars 36, 38 and 40 are constructed of a suitable structural material such as tubular steel which has been double-wall reinforced at each end. The tubular pad 42 can be constructed of a soft, compressible material such as sponge rubber.

As disposed upon the bracket 26 in the manner described above, the seat 10 is cantilevered at the front legs 18. Because the side frame members 30 have spring action mechanical properties, the seat 10 will deflect downwardly and the back will deflect rearwardly and downwardly when an individual sits in the chair. The chair assembly described above provides a strong support for the seat of the chair and yet provides for the resilient rocking or lilting action by the occupant. For a maximum of both stability and dynamic comfort, it is preferable for the seat 10 to deflect downwardly a distance of between about 0.2 and 0.5 inches or more at a point measured twelve inches horizontally back from the forward edge of the seat 10 under a load of 100 pounds placed twelve inches horizontally back from the forward edge of the seat 10. For similar reasons, it is preferable that the back 12 deflects a distance of between about 1 and 2 inches or more at a point measured vertically from the seat 10 under a 50 pound load directed horizontally at a point twelve inches vertically above the seat 10. The period of these deflections is preferably between about 200 and about 400 cycles per minute, i.e., an undamped primary elastic period of vibration along the plane of the seat 10.

Figure 19:
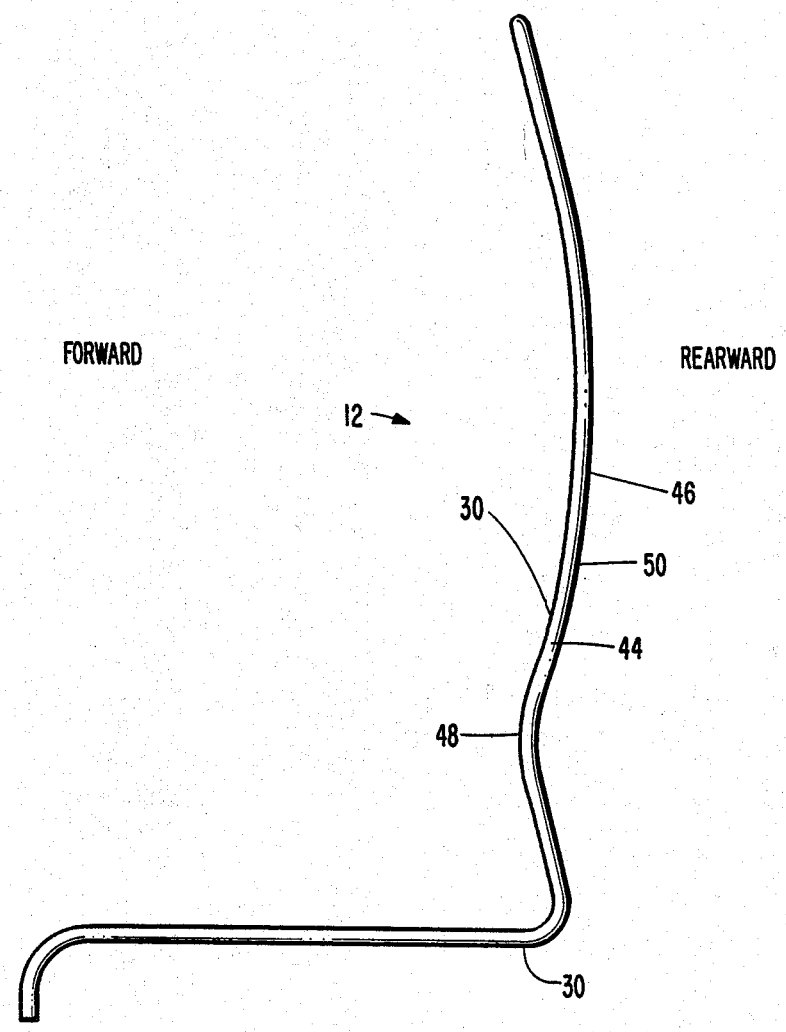
FIG. 19 is a side view of a side member useful in the invention.
Figure 20:
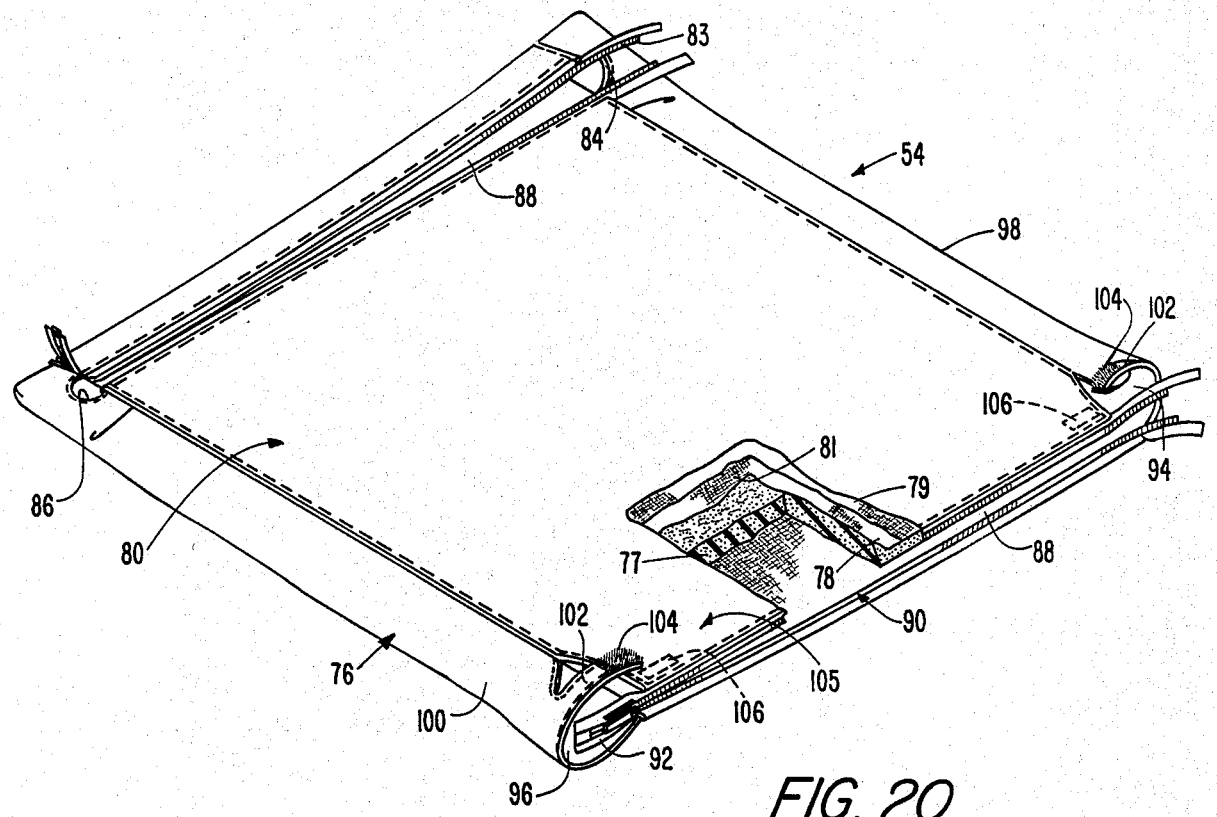
FIG. 20 is a prospective view of a removable seat cover embodying featues of the invention.
Figure 21:
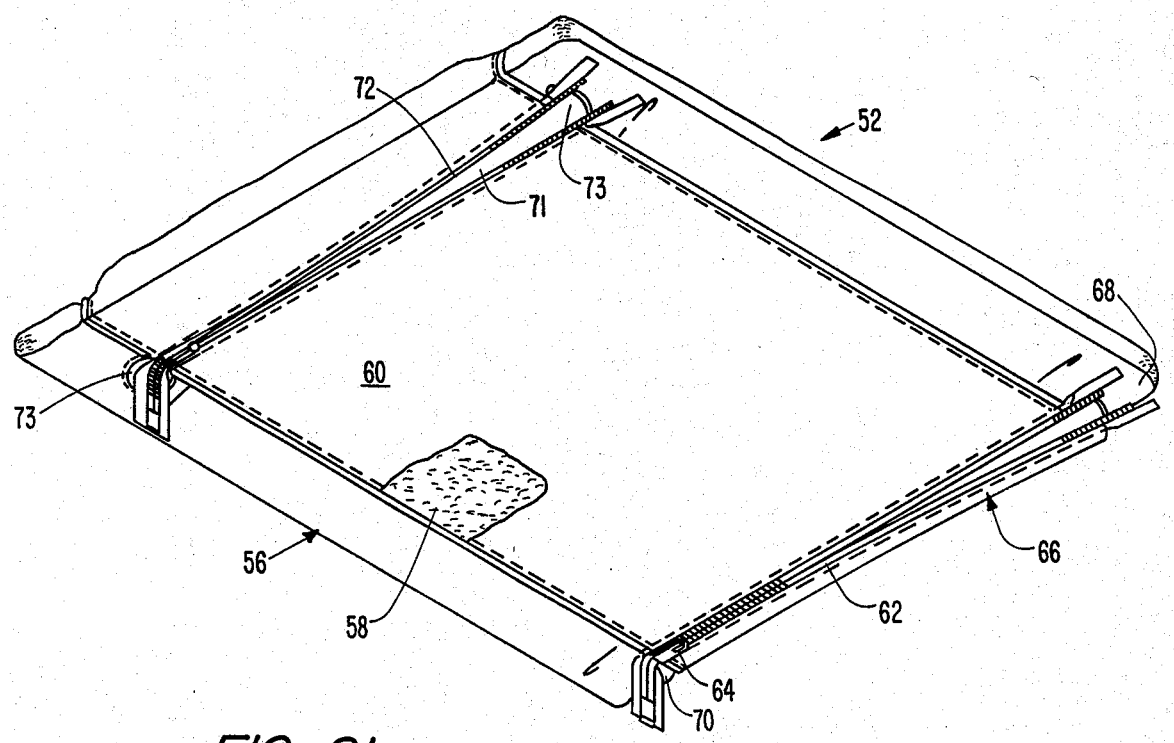
FIG. 21 is a prospective view of a removable back cover embodying features of the invention.

The side frame members 30 are advantageously orthopedically designed for comfort and excellent spinal support. Referring to FIG. 19, the vertical portion of the L-shaped side frame members 30 are preferably S-shaped so as to give the back an S-shaped planar surface having a lower back section 44 which is convex relative to the forward side of the back 12, and an upper back section 46 which is gently concave relative to the forward side of the back 12. The convex lower back section 44 has a radius of curvature at its apex 48 of from about four to about seven inches, and preferably about five and one-half inches. The concave upper back section 46 of the high back embodiment has a radius of curvature at its apex 50 of from about thirty to fifty inches, and preferably about forty inches. The apex 48 of the convex lower back section is from about five to abut eight inches, and preferably about seven inches, above the seat. The apex 50 of the concave upper back section 46 is rearward of the apex 48 of the convex lower back section 44 by about two to about four inches measured parallel to the seat when the chair is unoccupied.

Preferably for maximum comfort, the chair is high-back, with the top of the back of the chair being between about twenty five and about thirty inches above the seat, preferably twenty seven inches. In the lowback embodiment, the top of the back is between about fifteen and twenty one inches, preferably eighteen inches.

As shown in FIG. 19, the mid-section of the back 12 between the apices 48 and 50 extends rearwardly and upwardly at an angle of from about 74 to about 77 degrees, and preferably about 75½ degrees, relative to the seat. The section from the apex 50 of the concave upper back section 46 to the top of the back 12 extends forwardly and upwardly at an angle of from about 72 to about 77 degrees, and preferably about 74½ degrees, relative to the seat.

Optionally, the back center piece 32 can be a removable back cover 52 and the seat center piece 34 can be a removable seat cover 54. The back cover 52 is comprised of an exterior back envelope 56, a back pad 57, and, preferably, a forward back liner 58, and a rearward back liner 59. The exterior back envelope 56 is sized to fit snugly over the vertical portion of the side frame members 30 so as to form a surface against which an individual can lean. The back pad 57 is approximately the same size as the internal volume of the back envelope 56 and is disposed within the back envelope 56 to form a padded back rest. The back cover 52 has a forward side (not shown) and a rearward side 60. The rearwad back liner 59 is disposed in parallel with and affixed to the rearward side 60. The forward back liner 58 is affixed in parallel with and adjacent to the rearward back liner 59. Both the forward back liner 58 and the rearwad back liner 59 are substantially the same size and shape as the plane of the back pad 57. The forward back liner 58 and the rearward back liner 59 form a lined interior back volume 61. Preferably, for tensile strength, the back liners 58 and 59 are composed of a stong material such as a closely woven nylon. The back pad 57 is approximately the same size as the back panel between the side frame members 30 and is encased between the forward side and the forward back liner 58. Both the forward back liner 58 and the rearward back liner 59 are substantially the same size and shape as the back pad 57. As so encased, the back pad 57 forms a comfortable cushioned back rest. The exterior back envelope 56 has a lower edge opening 62 which exposes the interior of the back envelope 56 along substantially the entire length of the lower end 66 of the back envelope 56. A back lower end fastener 64, such as a zipper, is affixed within the lower edge back opening 62 and is adapted to close the entirety of the lower edge back opening 62 except for a left lower back gap 68 and a right lower back gap 70. The gaps 68 and 70 are both approximately the same diameter as the diameter of the lower back transverse bar 38 and are located at either end of the back lower end fastener 64.

The exterior back envelope 56 also has an upper transverse back opening 71 which exposes the interior of the back envelope 56. The upper transverse back opening 71 is disposed so that it is aligned with the upper back transverse bar 40 when the back envelope 56 is attached over the vertical portion of the side frame members 30. A back upper end fastener 72, such as a zipper, is affixed within the upper transverse back opening 71 and is adapted to close the entirety of the upper transverse back opening 71 except for a left upper back gap 73 and a right upper back gap 74. The gaps 73 and 74 are both approximately the same diameter as the diameter of the upper seat transverse bar 40 and are located at either end of the back upper end fastener 72.

The removable seat cover 54 is comprised of an exterior seat envelope 76, a seat pad 77, and, preferably, an upper back liner 78, and a lower back liner 79. The exterior seat envelope 76 is sized to fit snugly over the horizontal portion of the side frame members 30 so as to form a surface upon which an individual can sit. The interior seat pad 77 is approximately the same size as the internal volume of the seat envelope 76 and is disposed within the seat envelope 76 to form a padded sitting surface. The removable seat cover 54 has an upper side (not shown) and a lower side 80. The lower seat liner 79 is disposed in parallel with and affixed to the lower side 80. The upper seat liner 78 is affixed in parallel with and adjacent to the lower seat liner 79. As so disposed, the upper seat liner 78 and the lower seat liner 79 form a lined interior seat volume 81. Preferably, for tensile strength, the seat liners 78 and 79 are composed of a strong material such as a closely woven nylon. The seat pad 77 is approximately the same size as the seat's upper side and is encased between the upper side and the upper seat liner 78. Both the upper seat liner 78 and the lower seat liner 79 are substantially the same size and shape as the plane of the seat pad 77. The seat pad 77 forms a comfortable cushioned sitting surface. The exterior seat envelope 76 is adapted with a forward transverse seat opening 82 which exposes the interior of the seat envelope 76 along substantially the entire width of the seat cover 54. The seat envelope 76 is constructed so that the forward transverse seat opening 82 is aligned with the forward seat transverse bar 36 when the seat envelope 76 is attached over the horizontal portion of the side frame members 30. A seat forward end fastener 83, such as a zipper, is affixed within the forward transverse seat opening 82 and is adapted to close the entirety of the forward transverse seat opening 82 except for a left forward seat gap 84 and a right forward back gap 86. The gaps 84 and 86 are both approximately the same diameter as the diameter of the forward seat transverse bar 38 and are located at either end of the seat forward end fastener 83.

The exterior seat envelope 76 also has a rearward edge opening 88 which exposes the interior of the seat envelope 76 along substantially the entire length of the rearward end 90 of the seat envelope 76. A seat rearward end fastener 92, such as a zipper, is affixed within the rearward seat opening 88 and is adapted to close the entirety of the rearward edge opening 88 except for a left rearward seat gap 94 and a right rearward seat gap 96. The circumference of the gaps 94 and 96 are both approximately the same as the circumference of the side frame members 30. The rear-most portions of the left side 98 and the right side 100 of the exterior seat envelope 76 are each shaped to form a strap 102. The length of each strap is less than about one-half the length of the rearward end 90. Attached at the end of each strap is the first side 104 of a quickrelease fastener 105 such as a snap or a "VELCRO" ® fastener. A second side 106 of the fastener 105 is attached on the inside of the exterior seat envelope 76 at a distance from the side of the envelope 76 approximately the same as the length of the corresponding strap 102. As so disposed, the straps 102 can be slipped within the exterior seat envelope 76 and fastened at their ends by attaching the first side 104 of each fastener to the second side 106.

As so constructed, the removable seat cover 54 and the removable back cover 52 can be easily removed from the chair for cleaning or repair. This is an important feature in a patient-chair since sickly and infirm patients soil a chair with greater frequency than do healthy individuals. To replace the removable seat cover 54, the seat 10 is detached from the base 8 by removing the bolts 28. The rear end fastener 64 and forward transverse seat opening 71 are opened. The first sides 104 of the quick-release fasteners 105 are detached from the second sides 106. The seat cover 54 is slipped over the rearward seat transverse bar 38 and the forward seat transverse bar 36 and off the seat 10 at the front. A fresh seat cover 54 can then be placed onto the seat 10 by reversing the procedure above. The removable back cover 52, is detached from the back 12 in similar fashion except that the back 12 need not be removed from the base 8. The lower end fastener 92 and the back upper end fastener 83 are opened. The back cover 52 is thereafter slipped over the upper back transverse bar 40 and off the back 12 at the top. A fresh back cover 52 can then be placed onto the back 12 by reversing the back cover detachment procedure.

Figure 22:
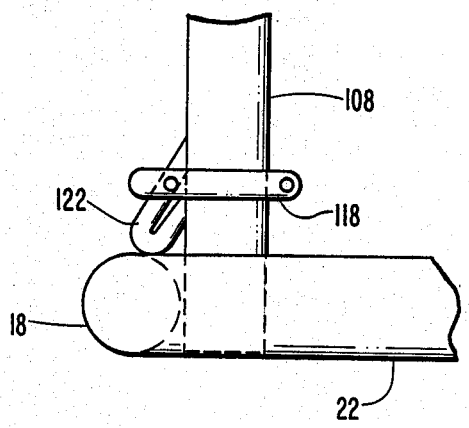
FIG. 22 is a top view of a beam connection embodying features of the invention.

The chair of the invention is not restricted to embodiments having a single seat and a single back. As illustrated in FIGS. 13–18, multiple seats 10 can be affixed to a crossbeam 108 with the crossbeam brackets 118 and the crossbeam bolts 120. The crossbeam brackets 118 can be made of flat steel plate. Preferably the crossbeam brackets 118 are made from angle iron having a vertical flange so that when the crossbeam brackets 118 are affixed to the crossbeam 108, the crossbeam brackets 118 are slightly raised above the crossbeam 108. The raised crossbeam brackets 118 prevent the resilient seat 10 from contacting the crossbeam 108 when occupied. The crossbeam 108 is affixed to the front legs 18. FIG. 22 illustrates in detail one method of affixing the crossbeam 108 to the front legs 18. The crossbeam 108 is welded in back of the front leg 18 and held and made rigid by means of an angle brace 122 welded on a bias to the back of the front leg 18. For additional rigidity, an angle brace 122 is welded on a bias between the crossbeam 108 and the front leg 18. For aesthetic purposes it is preferable that the width of the apex of the angle brace 122 is narrower in lateral side view than the diameter of the front leg 18. Such narrow width prevents the angle brace 122 from being visible from the side of the chair 6. The angle brace 122 can be a piece of steel plate folded into an acute angle of unequal leg length. A rigid intermediate armrest 112 can be affixed to the crossbeam 108 in between each pair of seats 10. Alternatively, two parallel intermediate armrests 112 can be affixed to the crossbeam 108 in between each pair of seats 10 to provide an armrest 112 on each side of each and every seat 10. There is no theoretical limit to the number of seats 10 which can be incorporated in the chair in this manner. Chairs with one to five seats are typical.

The foregoing describes a chair embodying features of the invention having a base 8 formed by two front legs 18, two armrests 22, and two sled base members 20, the front legs 18 and the sled base members 20 being affixed together by a lateral brace 24. Other base configurations are also possible in the invention so long as they provide two front legs 18 which extend above the seat and then horizontally to form armrests which are substantially rigid along their entire length, and a stable support for the seat 10 and back 12. For example, FIGS. 7–12 illustrate an alternative base comprised of (i) two essentially non-deflecting front legs 18 which extend upwardly in a substantially vertical direction and then rearwardly in a substantially horizontal direction to form rigid armrests 22, (ii) two essentially non-deflecting rear legs 114 each of which is connected at its uppermost end to the rearmost end of one of the armrests 22 such that the rear legs are disposed substantially vertically and substantially in parallel with each other, and (iii) a lateral brace 24 affixed at each of its ends to one of the rear legs 114.

Figure 23:
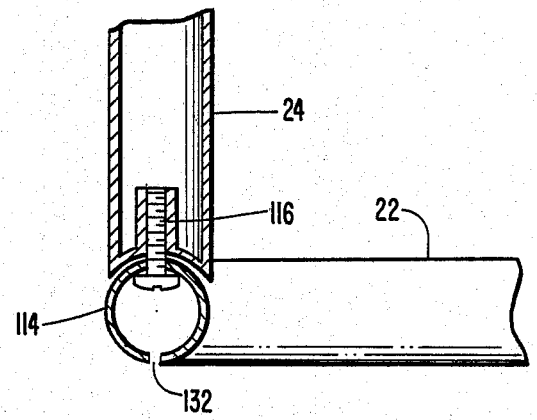
FIG. 23 is a top view of a lateral brace connection embodying features of the invention.

Optionally, the alternative base illustrated in FIGS. 7–12 can comprise armrest covers 23 as illustrated on the embodiment depicted in FIGS. 1–5. Since it is often desirable to be able to replace the armrest covers 23, armrest covers 23 for the alternative base illustrated in FIGS. 7–12 can be constructed of a rigid C-shaped material such as spring steel with or without a soft overcovering. Alternatively the armrest covers 23 can be tubular shaped as illustrated in FIGS. 1–5. For tubular shaped armrest covers 23 to be replaceable, provision must be made for the easy removable of the lateral brace 24 (so that the tubular covers 23 can be slipped onto and off of the rear legs 114). Such a provision is illustrated in FIG. 23. The lateral brace 24 is bolted to each rear leg 114 by means of a captive screw 116 threaded within the rear leg 114. Access to the captive screw 116 is afforded by a small hole 132 in the side of the rear leg 114 opposite the socket head of the captive screw 116.

The chair article of the invention provides an inexpensive patient-chair from which it is easy to ingress and egress and yet is comfortable for prolonged sittings. A significant advantage over patient-chairs of the prior art is the feature of the invention of a chair capable of a gentle rocking (lilting) movement having armrests which are rigid along their entire lengths. This unique feature provides a thoroughly stable base from which an individual can find support during ingress and egress. Of equal importance, it provides a thoroughly stable base of support during those first movements after egressing when an invalid may be wobbly and in need of stable support. A further important advantage of the rigid armrests is that the invention provides a stable chair capable of a gentle rocking motion whose base takes up relatively little space.

Although the present invention has been described in considerable detail with regard to various versions thereof, other versions are possible. For example, the seat center piece 32 and the back center piece 34 need not be constructed of a fabric. Any construction material can be used so long as it is strong enough to withstand the forces exerted by a seated individual and yet comfortable when sat upon. Therefore, the spirit and scope of the appended claims should not necessarily be limited to the description of the preferred embodiments described herein.

What is claimed is:

1. A chair comprising:

a. a rearwardly extending, substantially horizontal, downwardly deflecting seat means having a front and a rear for supporting a human body in a seated position;

b. a pair of substantially rigid, substantially vertical front legs spaced apart from each other;

c. a pair of substantially parallel, non-deflecting armrests disposed in spaced relation to one another, each armrest extending rearwardly from a respective one of the front legs; and d. structure means for cantilevering the seat means below the armrests from the front legs at the front of the seat means so that the seat means can provide a rocking motion that increases rearwardly while the seat means is non-downwardly deflecting at its front edge;

wherein an individual seated upon the chair can support each of his arms upon one of the armrests so that an individual ingressing into and egressing from the chair can support his weight by pressing against the armrests with his hands, and wherein the front of the seat means and the front of the armrests are in substantially the same vertical plane for ease of ingres and egress.

2. The chair defined in claim 1 further comprising a back means affixed to the seat means and extending vertically above the seat means for providing support for the back of an individual sitting upon the seat means, wherein the back means can deflect rearwardly.

3. The chair defined in claim 2 wherein the seat means and the back means are comprised of two continuous side members affixed substantially parallel in spaced relation to each other by at least one cross-connecting transverse bar.

4. The chair defined in claim 3 wherein the side members are constructed of spring steel.

5. The chair defined in claim 2 or 3 wherein the back means is an S-shaped planar surface having a lower back section which is convex relative to the forward side of the planar surface and an upper back section which is concave relative to the forward side of the planar surface.

6. The chair defined in claim 2 wherein the seat means deflects downwardly a distance of between about 0.2 and 0.5 inches when 100 pound weight is placed on the seat means at a distance about 12 inches rearwardly from the forward side of the seat means.

7. The chair defined in claim 6 wherein the undamped primary elastic period of vibration along the plane defined by the seat means is between about 200 and about 400 cycles per minute.

8. The chair defined in claim 2 wherein the back means deflects horizontally a distance of between about 1 and about 2 inches when a force of 50 pounds is applied horizontally to the back means at a point about 12 inches above the seat.

9. The chair defined in claim 1 comprising more than one seat means.

10. The chair defined in claim 3 wherein the seat means comprises a first fabric piece attached horizontally between the side frame members and the back means comprises a second fabric piece attached vertically between the side frame members.

11. The chair defined in claim 10 wherein either the first fabric piece, the second fabric piece or both is removable and reattachable.

12. The chair defined in claim 1 wherein the structure means further comprises a pair of sled base members each affixed to one of the front legs such that the two sled base members extend horizontally and rearwardly in parallel to form the base of the chair.

13. The chair defined in claim 1 wherein the structure means further comprises a pair of rigid rear legs, and means for affixing each of the rear legs to one of the front legs so that the rear legs are disposed substantially vertically and substantially in parallel with each other.

14. The chair defined in claim 1 wherein the armrests are substantially horizontal.

15. The chair defined in claim 1 wherein each front leg extends upwardly in a substantially vertical direction and then rearwardly in a substantially horizontal direction to form one of the armrests.

16. The chair defined in claim 11 wherein at least one of the cross-connecting transverse bars is U-shaped and the first fabric piece comprises:

(a) a cover defining an interior seat volume having a top side, a bottom side, a left side, a right side, a forward end and a rear end, wherein the cover has a rear edge opening across the length of the rear end and a transverse bar opening which, when the chair seat is attached to the chair, is aligned with the U-shaped transverse bar;

(b) a seat pad disposed within the cover, the seat pad being of substantially the same size and shape as the interior seat volume;

(c) a rear end fastener for closing the rear edge opening; and (d) a transverse bar opening fastener for closing the transverse bar opening except for a left gap at the left side of the transverse bar opening and a right gap at the right side of the transverse bar opening, wherein the left gap and the right gap have substantially the same diameter as the U-shaped transverse bar so that, when the chair seat is in use with the transverse bar opening fastener closed, the U-shaped transverse bar protrudes out of the left gap and back into the right gap.

17. The chair defined in claim 16 further comprising:

(a) an upper seat liner affixed within the cover adjacent to and in parallel with the seat pad; and (b) a lower seat liner affixed within the cover adjacent to and in parallel with the bottom side of the cover; wherein the upper seat liner and the lower seat liner are substantially the same size and shape as the plane of the seat pad.

18. The chair defined in claim 17 wherein the rear end fastener and the transverse bar fastener are zippers.

19. The chair defined in claim 11 wherein at least one of the cross-connecting transverse bars is U-shaped and the second fabric piece comprises:

(a) a cover defining an interior back volume having a forward side, a rearward side, a left side, a right side, an upper end and a lower end, wherein the cover has a lower edge opening across the length of the lower end and a transverse bar opening which, when the seat is attached to the chair, is aligned with the U-shaped transverse bar;

(b) a back pad disposed within the cover, the back pad being of substantially the same size and shape as the interior back volume;

(c) a lower end fastener for closing the lower edge opening; and (d) a transverse bar opening fastener for closing the transverse bar opening except for a left gap at the left side of the transverse bar opening and a right gap at the right side of the transverse bar opening, wherein the left gap and the right gap have substantially the same diameter as the U-shaped transverse bar so that, when the chair back is in use with the transverse bar opening fastener closed, the U-shaped transverse bar protrudes out of the left gap and back into the right gap.

20. The chair defined in claim 19 wherein the second fabric piece further comprises:

(a) a forward seat liner affixed within the cover adjacent to and in parallel with the back pad; and (b) a rearward seat liner affixed within the cover adjacent to and in parallel with the rearward side of the cover; wherein the forward seat liner and the rearward seat liner are substantially the same size and shape as the plane of the back pad.

21. The chair defined in claim 20 wherein the lower end fastener and the transverse bar fastener are zippers.

22. A chair having a front and a rear and capable of a rocking motion, comprising:

(a) a base comprising a pair of substantially rigid front legs extending upwardly in a generally vertical direction and then rearwardly in a substantially horizontal direction to form rigid armrests;

(b) a substantially horizontal seat having a front and a rear; and (c) a back extending vertically above the seat;

wherein the seat and the back are comprised of the two steel side members affixed in parallel relation by cross-connecting transverse bars and fabric stretched between the side members to form a sitting surface and a back rest, wherein the seat is cantilevered near its front to each of the front legs below the armrests so as to be non-downwardly deflecting at its front and downwardly deflecting at its rear to provide a rocking motion that increases rearwardly, wherein the seat deflects downwardly a distance between about 0.2 and about 0.5 inches when a 100 pound weight is placed on the seat at a distance about 12 inches rearwardly from the front of the seat, wherein the back is S-shaped and deflects horizontally in a rearward direction when a force of 50 pounds is applied horizontally and rearwardly to the back at a point about 12 inches below the seat, and wherein the front of the seat and the front of the armrests are in substantially the same vertical plane for ease of ingress and egress.

23. The chair defined in claim 22 wherein the base comprises a pair of substantially rigid rear legs, wherein each of the rear legs is attached to the rearmost end of one of the armrests such that each of the front legs is disposed in substantially the same plane as one of the armrests and one of the rear legs.

24. The chair defined in claim 22 comprising at least two seats, a crossbeam and an intermediate armrest wherein each end of the crossbeam is affixed to one of the front legs below the armrest, wherein the seats are attached near their front edges to the crossbeam so as to be rearwardly cantilevered, wherein the intermediate armrest is attached to the crossbeam between two of the seats, and wherein the intermediate armrest extends vertically above the crossbeam and then rearwardly in a substantially horizontal disposition so as to maintain a parallel disposition relative to the front legs.

25. The chair defined in claim 22 wherein the transverse bars are U-shaped and the seat comprises a removable chair seat comprising:

(a) a cover defining an interior seat volume having a top side, a bottom side, a left side, a right side, a forward end and a rear end, wherein the cover has a rear edge opening across the length of the rear end and a transverse bar opening which, when the seat is attached to the chair, is aligned with a lower one of the U-shaped transverse bars;

(b) a seat pad disposed within the cover, the planar configuration of the seat pad being substantially the same as the planar configuration of the interior seat volume;

(c) a rear end fastener for closing the rear edge opening;

(d) a transverse bar opening fastener for closing the transverse bar opening except for a left gap at the left side of the transverse bar opening and a right gap at the right side of the transverse bar opening, wherein the left gap and the right gap have substantially the same diameter as the lower U-shaped transverse bar so that, when the chair seat is in use with the transverse bar opening fastener closed, the lower U-shaped transverse bar protrudes out of the left gap and back into the right gap;

(e) an upper seat liner affixed within the cover adjacent to and in parallel with the seat pad; and (f) a lower seat liner affixed within the cover adjacent to and in parallel with the bottom side of the cover;

wherein the upper seat liner and the lower seat liner have substantially the same planar configuration as the planar configuration of the seat pad.

26. The chair as defined in claim 22 or 26, wherein the transverse bars are U-shaped and the back comprises a removable chair back that can be removed and replaced without disassembling the chair, the chair back comprising:

(a) a cover defining an interior back volume having a forward side, a rearward side, a left side, a right side, an upper end and a lower end, wherein the cover has a lower edge opening across the length of the lower end and a transverse bar opening which, when the back is attached to the chair, is aligned with an upper one of the U-shaped transverse bars;

(b) a back pad disposed wtihin the cover, the planar configuration of the back pad being substantially the same as the planar configuration of the interior back volume;

(c) a lower end fastener for closing the lower edge opening;

(d) a transverse bar opening fastener for closing the transverse bar opening except for a left gap at the left side of the transverse bar opening and a right gap at the right side of the transverse bar opening, wherein the left gap and the right gap have substantially the same diameter as the upper U-shaped transverse bar so that, when the chair back is in use with the transverse bar opening fastener closed, the upper U-shaped transverse bar protrudes out of the left gap and back into the right gap;

(e) a forward seat liner affixed within the cover adjacent to and in parallel with the back pad; and (f) a rearward seat liner affixed within the cover adjacent to and in parallel with the rearward side of the cover;

wherein the planar configuration of the forward seat liner and the rearward seat liner substantially the same as the planar configuration of the back pad.

27. The chair of claim 22 wherein the base comprises a pair of sled base members and a lateral brace, wherein each of the sled base members is attached to a respective one of the front legs at the lowermost portion of the leg and extends horizontally in a rearward direction and parallel with the armrests, and wherein the lateral brace is disposed horizontally at right angles to the sled base members and is attached at each end to the rearmost end of one of the sled base members.

28. A multiple seat chair comprising:

(a) a pair of substantially rigid, substantially vertical front legs spaced apart from each other;

(b) a pair of substantially parallel, nondeflecting outer armrests disposed in spaced relation to one another, each armrest extending rearwardly from a respective one of the front legs;

(c) a substantially horizontal seat support means secured to and extending between the legs below the armrests; and (d) a pair of rearwardly extending, substantially horizontal, downwardly deflecting seat means having a front and a rear, each seat means defining an independent seat and each seat means being independently cantilevered below the armrests from the seat support means at the front of the seat means so that each seat means can provide a rocking motion that increases rearwardly while each seat means is non-downwardly deflecting at its front, and wherein the front of each seat means of the chair and the front of the outer armrests are in substantially the same vertical plane for ease of ingress into and egress out of the seats.

29. The chair of claim 28, including an inner armrest between the seat means, the inner armrest being supported by the seat support means.

30. The chair of claim 28 in which the seat support means comprises a cross-beam.

31. The chair of claim 28 further comprising a back means for each seat means, each back means being affixed to its respective seat means and extending vertically above the seat means for providing support for the back of an individual sitting upon the seat means.

32. The chair of claim 31 wherein each seat means and its respective back means are comprised of two continuous side members affixed in substantially parallel spaced apart relation to each other by at least one cross-connection transverse bar.

33. The chair of claim 28 or 29 in which the armrests are substantially horizontal.

34. The chair of claim 28 wherein each front leg extends upwardly in a substantially vertical direction and then rearwardly in a substantially horizontal direction to form one of the outer armrests.

35. The chair of claim 22 wherein the deflection of the back is between about 1 and 2 inches.

36. The chair of claim 22 wherein the undamped primary elastic period of vibration along the plane defined by the seat means is between about 200 and about 400 cycles per minute.

* * * * *